United States Patent [19]

Mitchell et al.

[11] 4,004,477

[45] Jan. 25, 1977

[54] FABRIC CUTTING APPARATUS

[75] Inventors: William O. Mitchell; Billy R. Moore, both of Vidalia, Ga.

[73] Assignee: Oxford Industries, Inc., Atlanta, Ga.

[22] Filed: June 2, 1975

[21] Appl. No.: 582,723

[52] U.S. Cl. ..... 83/23; 83/409.1; 83/425.2; 83/435.2; 83/806; 83/808; 83/925 CC

[51] Int. Cl.[2] ..... B26D 1/52

[58] Field of Search ..... 83/425, 23, 425.2, 425.3, 83/425.4, 409, 925 CC, 435.2, 806, 808

[56] References Cited

UNITED STATES PATENTS

| | | | |
|---|---|---|---|
| 1,285,801 | 11/1918 | Rudy | 83/806 X |
| 1,863,303 | 6/1932 | Goad | 83/425.2 X |
| 3,154,124 | 10/1964 | Cimino | 83/425.2 X |
| 3,242,954 | 3/1966 | Schikofsky | 83/425.2 |
| 3,735,787 | 5/1973 | Siel | 83/425.2 X |
| 3,832,927 | 9/1974 | Warnock et al. | 83/925 CC X |
| 3,875,841 | 4/1975 | Noble et al. | 83/808 X |
| 3,888,150 | 6/1975 | Stroud et al. | 83/425.2 X |

*Primary Examiner*—Frank T. Yost
*Attorney, Agent, or Firm*—Jones, Thomas & Askew

[57] ABSTRACT

Fabric cutting apparatus for accurately cutting over-cut pattern pieces, including a pair of band knives spaced apart a distance equal to the width of the pattern pieces, and a plurality of clamp members which hold a stack of the over-cut pattern pieces while a continuous conveying means carries the clamp members between the band knives for cutting.

13 Claims, 8 Drawing Figures

FABRIC CUTTING APPARATUS

BACKGROUND OF THE INVENTION

This invention relates to fabric cutting apparatus, and is more particularly concerned with apparatus wherein a stack of fabric is held and moved past band cutters for accurately cutting pattern pieces from the stack of fabric.

In the past, pattern pieces have been rough-cut from a large stack of fabric; and, some pattern pieces are useable in their rough-cut form whereas other pattern pieces must be re-cut more accurately. The conventional method for accurately re-cutting pattern pieces has been through the use of mating dies, but there are certain inherent problems with such method. A recently developed system for accurately re-cutting pattern pieces is disclosed in U.S. Pat. No. 3,832,297 wherein a stack of overcut pattern pieces is held and moved relative to a pair of rotating circular knives, with the knives being properly spaced to cut the fabric to the desired size. A single operator must load fabric into a carrying means, place a holding means on top of the fabric, and continue to hold the fabric down while the fabric is passed across the circular knives; then, the same operator must remove the holding means and remove the cut fabric. All of this activity takes place within a small space so that the operator is limited in his total activity. Also, since the cutting means are circular knives, the maximum thickness of fabric to be cut must necessarily be somewhat less than the radius of the circular knives.

SUMMARY OF THE INVENTION

The present invention comprises a pair of spaced-apart band knives, each band knife comprising a continuous loop with a vertical portion in the fabric cutting area. The vertical portions of the two band knives are parallel to each other and move in the same direction at the same speed. A continuous conveying system having a plurality of clamp means carried thereby moves between the vertical portions of the two band knives, stacks of overcut pattern pieces are placed into the clamp members by one operator, and the conveying system carries the overcut pattern pieces along the conveying system and past the band knives which are appropriately spaced to cut the pattern pieces to the desired width. The clamp members are further carried by the conveying means beyond the band knives, around a continuous return flight and back to the same operator where the same operator removes the cut pattern pieces from the clamp means, replaces the cut pieces with a stack of overcut pattern pieces, and the process is repeated. The plurality of clamp means spaced along the moving conveying system causes the operator to have almost all his time occupied in removing the cut pattern pieces from the clamp means and inserting overcut pattern pieces to the clamp means so that both the man and the machine are occupied substantially one hundred percent of the time available. In conjunction with the present apparatus, there are means for controlling the scrap as the scrap is cut from the stack of overcut pattern pieces. Also, the particular clamp means is well adapted and particularly suited for use in the present system.

These and other features and advantages of the present invention will become apparent from consideration of the following specification when taken in conjunction with the accompanying drawings in which:

DESCRIPTION OF AN EMBODIMENT

Figure 1:
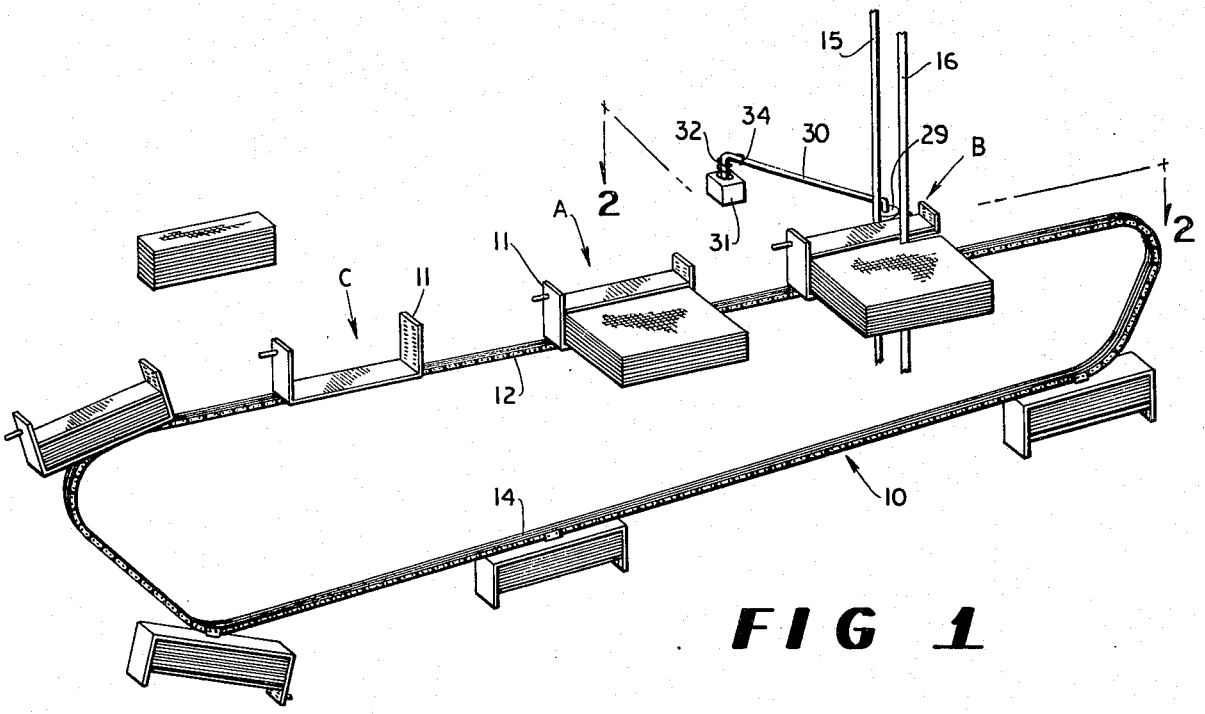
FIG. 1 is a schematic perspective view illustrating one form of apparatus made in accordance with the present invention.

Referring now more particularly to the drawings, and to that embodiment of the invention here chosen by way of illustration, it will be seen in FIG. 1 that there is a conveying means generally designated at 10, the conveying means 10 carrying a plurality of clamp members 11 thereon, the clamp members 11 being spaced apart around the complete loop of the conveying means 10. The conveying means 10, as here illustrated, includes an upper flight 12 and a lower flight 14. As will be discussed in more detail hereinafter, the upper flight 12 comprises the area in which the stacks of pattern pieces are placed within a clamp means 11, and the pattern pieces are cut.

Adjacent one end of the upper flight 12 of the conveying means 10 is a pair of band knives 15 and 16. The band knives 15 and 16 are represented in FIG. 1 by only short, straight, vertical portions which comprise a pair of cutting members, and it will be understood that the portions of the band knives that actually cut the fabric are the vertical straight portions.

Considering the sequence of steps briefly, it will be seen that a stack of overcut pattern pieces is placed into a clamp that functions as a carrier in an area generally designated as the loading station by the letter A. The pattern pieces placed in the clamp at A will be moved by the conveying means 10 to the band knives 15 and 16 which is designated as the cutting station B. After the pattern pieces are cut, the clamp means 11 carries the finished stack of pattern pieces around the conveying means and back to the operator to a point where the operator will remove the finished stack of pattern pieces from the clamp means, and this area is designated as the unloading station C. It will therefore be observed that the unloading station C is adjacent to the loading station A and that one operator will remove a stack of pattern pieces at station C and will immediately load a stack of overcut pattern pieces at station A.

Figure 2:
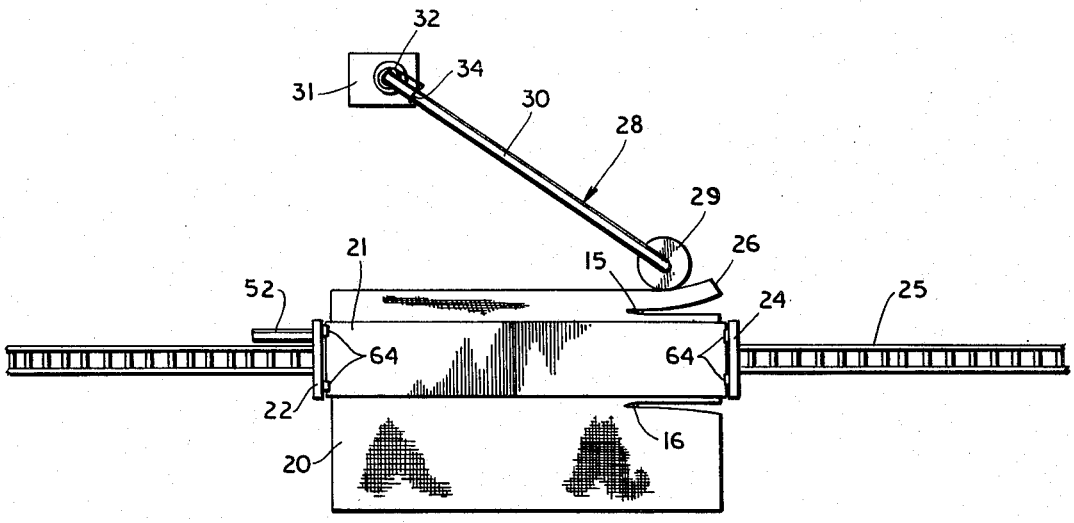
FIG. 2 is a cross sectional view taken substantially along the lines 2—2 in FIG. 2.

Referring now to FIG. 2 of the drawings, it will be seen that there is a stack of overcut pattern pieces in the form of a stack of fabric 20. The stack of fabric 20 is held down by a hold-down plate 21, the hold-down plate 21 being engaged by left and right clamp plates 22 and 24 respectively; and, it will be seen that the clamp member 11 as a whole is carried on a chain designated at 25, the chain 25 being an integral portion of the conveying means 10.

As illustrated in FIG. 2, the band knives 15 and 16 have cut somewhat into the stack of fabric 20 to trim the excess material away from the desired pattern piece, and it will be seen that the band knives 15 and 16 cut the fabric quite close to the hold-down member 21. This is desirable so that the fabric will be well-controlled by direct clamp pressure, and there will be substantially no fabric slip.

To assist further in controlling the fabric that is cut from the overcut pattern pieces, and more particularly to control the small edge of waste designated at 26, there is a waste controlling apparatus generally designated at 28. The waste controlling apparatus includes a pressure roll 29 that is journalled at the end of an arm 30. The pressure roll 29 is rotatable with respect to the arm 30 so that the stack of fabric 20 can move past the roll 29 with the roll 29 bearing against the stack of fabric and the roll 29 does not drag against and distort the stack of fabric; rather, the pressure roller 29 bears against the waste 26 and exerts sufficient pressure to control the waste so that it will not move about and interfere with subsequent cutting of fabric. The arm 30 is supported in a support block 31; and, the arm 30 is urged in a clockwise direction by a spring 32, the spring 32 being anchored on the block 31 and having an end of the spring engaging the arm 30 as indicated at 34. With this arrangement, it will be seen that the spring 32 will urge the arm 30 in a clockwise direction which urges the roll 29 against the stack of fabric 20. Since the roller 29 is free to rotate with respect to the arm 30, as the fabric 20 moves past the roll 29, the roll 29 will rotate to prevent dragging against the stack of fabric 20 but the pressure on the stack will prevent undue motion of the waste 26 from the stack of fabric 20. It should also be noted that the roll 29 exerts pressure substantially immediately behind the knife 15, and it has been found that pressure in this area affords the maximum control.

Figure 3:
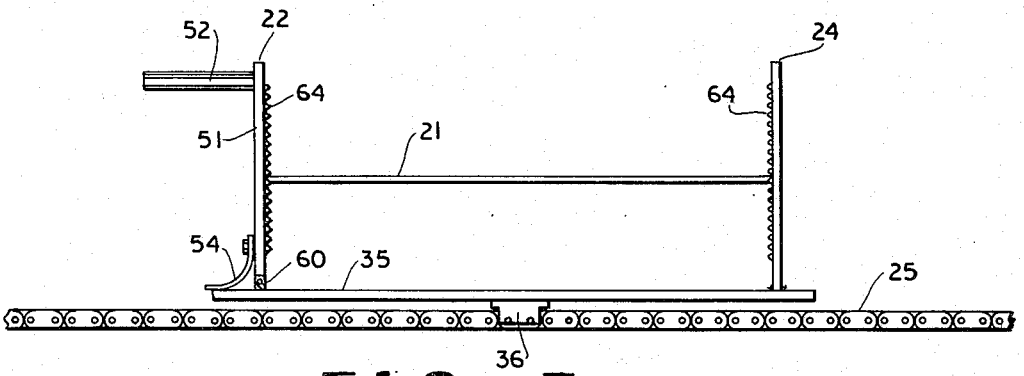
FIG. 3 is a side elevational view showing one clamp member and its attachment to the conveying means.
Figure 4:
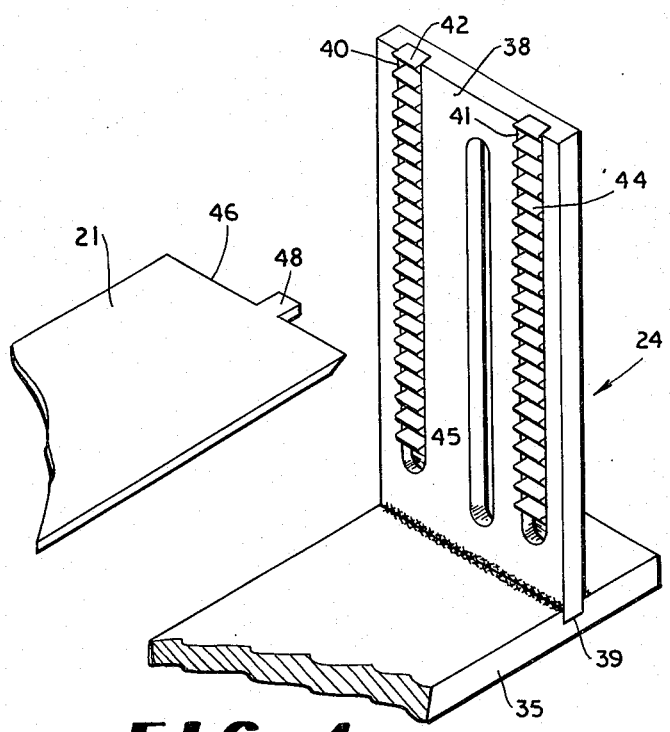
FIG. 4 is a perspective view illustrating the construction of the right-hand end plate of the clamp member shown in FIG. 3.
Figure 5:
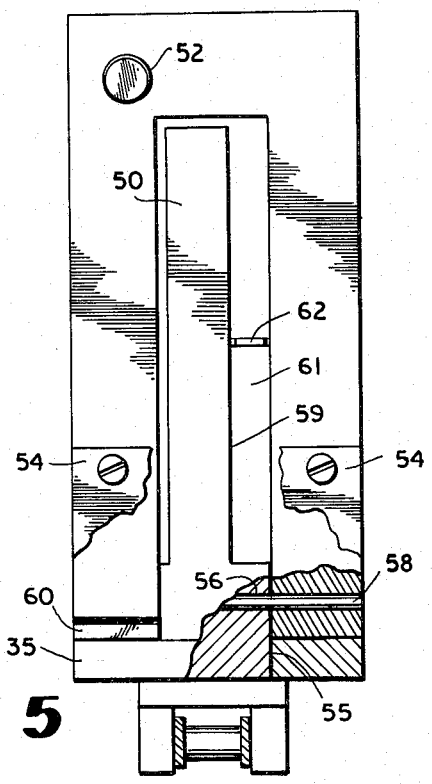
FIG. 5 is an end elevational view, partially broken away, showing the left-hand end plate of the clamp member illustrated in FIG. 3.

Attention is next directed to FIGS. 3, 4 and 5 of the drawings for a better understanding of the clamp means 11. Looking first at FIG. 3 of the drawings, it will be seen that the clamp member 11 includes a base 35 having a cleat 36 fixed thereto, the cleat 36 acting also as a master link in the chain 25. Thus, the base 35 of the clamp 11 is fixed to the chain 25 substantially at its midpoint, but is not otherwise fixed to the chain 25. The right-hand upstanding clamp plate 24 of the clamp member 11 comprises a vertically upstanding plate that is welded or otherwise fixed to the base member 35. The right-hand member 24 is better shown in FIG. 4 of the drawings where it will be seen that the right-hand member 24 includes a plate 38, the plate 38 being inserted into a groove 39 within the base plate 35, and the plate 38 is appropriately welded to retain the plate 38 within the groove 39. The plate 38 furthermore has a pair of parallel recesses 40 and 41, each of the recesses 40 and 41 receiving a rack gear 42 and 44 respectively; and, between the gears 42 and 44 and offset toward the gear 42, there is an elongated slot 45 that extends all the way through the plate 38 to act as a guide slot for the pressure plate or hold-down member 21.

The hold-down member 21 is substantially a flat plate having each end thereof adapted to be received by one of the upstanding clamp plates 22 and 24. Still looking at FIG. 4 of the drawings, it will be seen that the right-hand end 46 of the hold-down member 21 includes a tab 48 that is to be received within the slot 45. On each side of the tab 48, the end 46 is shaped as a chisel edge with the sharpened edge at the upper surface of the hold-down member 21. It will therefore be understood, with this arrangement, the end 46 of the hold-down member 21 will be received between the teeth of the gears 42 and 44 while the tab 48 is received within the slot 45. Thus, the hold-down plate 21 can be placed at any point along the height of the plate 38 and it will remain in place wherever it is positioned.

Referring now to FIGS. 3 and 5 of the drawings, it will be seen that the left-hand upstanding clamp plate 22 of the clamp member 11 is made up of a fixed stanchion 50 contained within the hinged member 51, the hinged member 51 being provided with a handle 52. There are also springs 54 provided to maintain the hinged member 51 in its vertical, upright position.

In more detail, it will be seen that the stanchion 50 is received within a slot 55 within the base plate 35, and is appropriately welded or otherwise fixed thereto. The stanchion 50 has aperture 56 therethrough to receive a hinge pin 58; and, somewhat above the aperture 56, the stanchion 50 has a cutout 59 that provides a slot similar to the slot 45 for receipt of a guide tab on the holddown member 21.

The hinged plate 51 is in the form of a bifurcated member having its lower ends beveled as at 60 to allow relief for pivoting of the plate 51 towards the left as viewed in FIG. 3 of the drawings. The pin 58 passes through the bifurcated ends of the plate 51 and acts as the hinge pin about which the plate 51 rotates.

There is a leaf spring 54 that is attached to the lower portion of the bifurcated plate 51; and, as seen in FIG. 3, the spring 54 is attached to the plate 22 and curves outwardly arcuately to bear against the extending end of the base plate 35. This spring arrangement will allow the spring 54 to be stressed when the plate 22 is moved counterclockwise as viewed in FIG. 3 so that the spring 54 will urge the plate 22 to its upright position.

Figure 6:
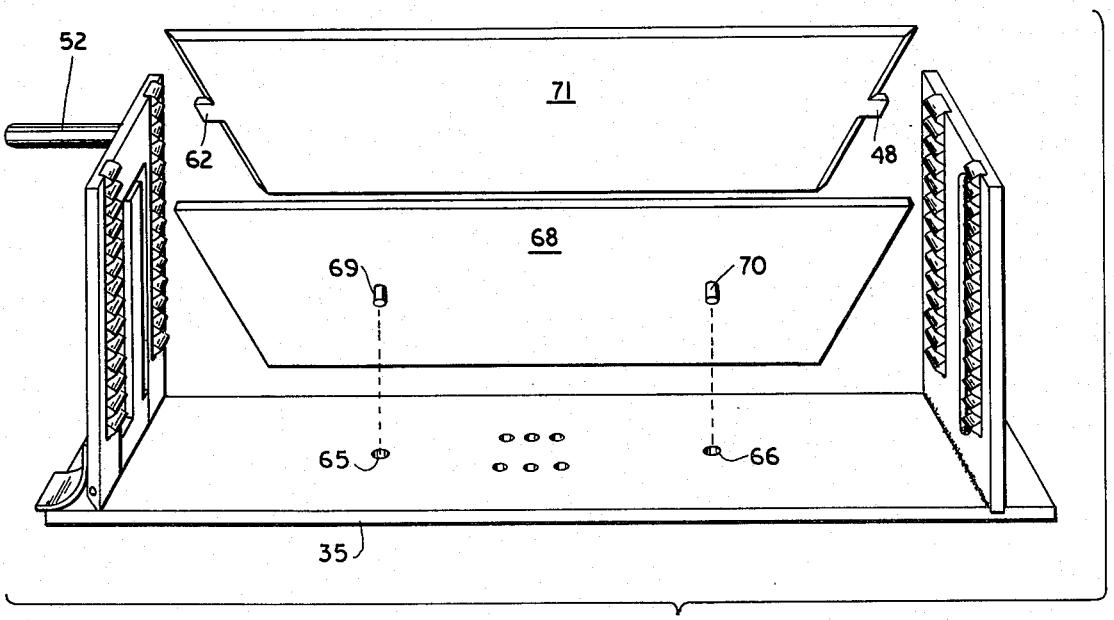
FIG. 6 is an exploded view illustrating a modification of the clamp member as shown in FIGS. 3–5.

As was previously mentioned, the cutout 59 of the stanchion 50 defines a slot 61 that is comparable to the slot 45 for receipt of a tab 48, the slot 61 receiving a tab 62 of the hold-down member 21. Also, the hinge plate 51 has a pair of gears 64 comparable to the gears 42 and 44 to receive the chisel edge of the hold-down plate 21 between the teeth of the gears 64 so that the overall arrangement is comparable to that described in connection with FIG. 4 of the drawings. There is one difference, however, in that the plate 22 can move away from the hold-down member 21 so that a ratcheting effect can be obtained. Because of this, the right-hand edge 46 of the hold-down plate 21 can be put into position, then the left-hand edge of the hold-down plate 21 can be moved downwardly allowing the hinge plate 51 to move outwardly with respect to the stanchion 50 and the hold-down plate can be moved down as far as the stack of fabric therebelow will allow. Attention is next directed to FIG. 6 of the drawings which shows a slight modification of the clamp means 11. As previously mentioned, the band knives 15 and 16 preferably cut closely adjacent to the hold-down plate 21 and the base plate 35 in order to control the stack of fabric that is carried in the clamp member 11. It would of course be difficult to replace the entire clamp member 11 since each of the clamp members is fixed to the chain 25 as shown in FIGS. 3 and 5 of the drawings. Rather than replace the entire clamp member 11, therefore, there is a pair of holes 65 and 66 in the base plate 35. The holes 65 and 66 are here shown as placed substantially along the longitudinal centerline of the base plate 35, but it will be understood by those skilled in the art that substantially any number of holes such as the holes 65 and 66 may be utilized, and the holes may be placed at any desired location within the base plate 35.

Cooperating with the hole 65 and 66 in the base plate 35, there is a secondary base plate 68, the secondary base plate 68 having complementary pegs 69 and 70 extending from the lower surface thereof. The pegs 69 and 70 are aligned with the holes 65 and 66 so that, when the secondary base plate 68 is juxtaposed on the base plate 35 the peg 69 will be received within the hole 65 and the peg 70 will be received within the hole 66. Once this is achieved, the secondary base plate 68 will be completely aligned with the base plate 35 so that there will be, in effect, a wider base plate 35.

For use with the secondary base plate 68 there is a secondary hold-down plate 71. The secondary hold-down plate 71 is substantially identical to the hold-down plate 21 in that the edges of the hold-down plate 71 are shaped as a chisel edge for receipt between the teeth of the gears 42, 44 and 64; also, the tabs 48 and 62 are located to be received within the slots 45 and 61 respectively. The only difference therefore is that the total width of the secondary hold-down plate 71 is greater than the hold-down plate 21. It will of course be understood that the secondary base plate 68 and the secondry hold-down plate 71 may be of substantially any width to conform to the desired pattern to be cut.

Figure 7:
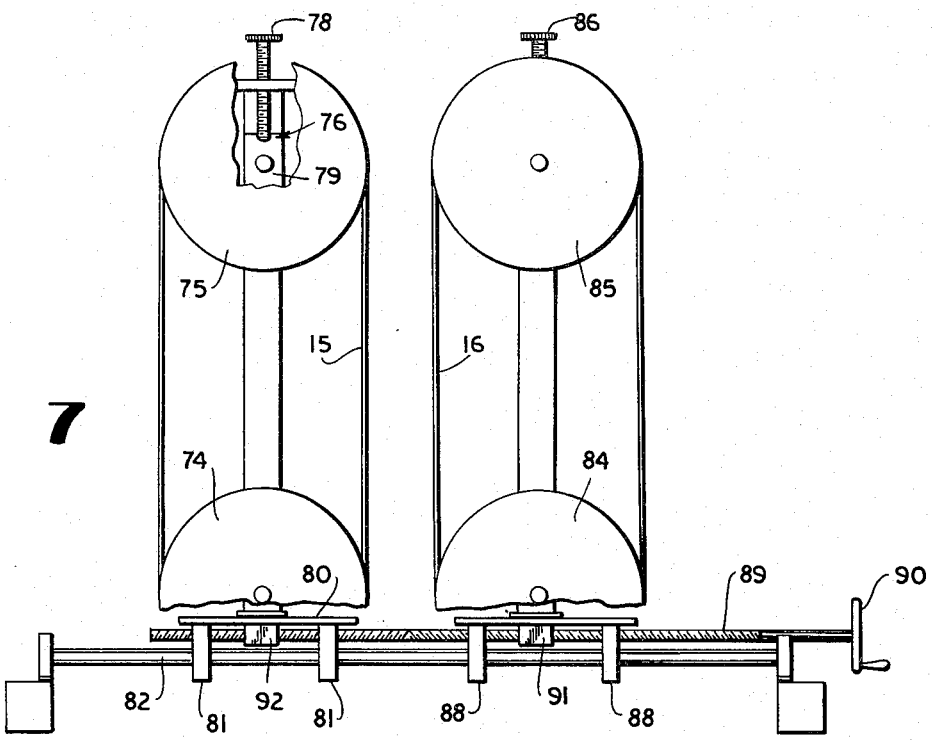
FIG. 7 is a front elevational view of the two band knives and their supporting structure, partially broken away to show the complete construction thereof; and, FIG. 8 is a perspective view showing the drive train for the two band knives.

Those skilled in the art will realize that the band knives are conventionally carried by a pair of wheels around which the band knife passes, one of the wheels being driven to cause the band knife to move in continuous fashion as the wheel is driven. Since the knives of the present invention need to move towards and away from each other, it will be understood that the wheels carrying the band knives must move towards and away from each other, and the arrangement for such motion is illustrated in FIG. 7 of the drawings. In FIG. 7 it will be seen that the band knife 15 is carried by a pair of wheels including a lower wheel 74 and an upper wheel 75, the upper wheel 75 being carried by a tensioning device indicated at 76 arranged so that rotation of a handle 78 will move the bearing block 79 upwardly to provide additional tension in the band 16. This general structure is well known in the art and no further description is deemed necessary.

The lower wheel 74 is appropriately journalled, the appropriate bearings being carried on a platform 80. The platform 80 is in turn carried by bearings 81 which receive a shaft 82 therethrough. Though only shaft 82 is here shown, it should be understood that there is a pair of shafts such as the shaft 82 for complete support of the platform 80; and, the platform is supported from both shafts by means of bearings 81 thereby allowing the platform 80 to move longitudinally of the shaft 82.

The band knife 16 is similarly mounted, including a lower wheel 84 and an upper wheel 85, the upper wheel 85 having a tensioning means adjustable by means of a handle 86. The lower wheel 84 is mounted on a platform that is in turn carried by bearings 88, the bearings 88 being received on the shaft 82.

In order to adjust the band knives 15 and 16 towards and away from each other, there is a double screw 89 having a crank handle 90 at the extending end thereof. The screw 89 passes through a traveling nut 91 on the bottom of the platform that carries the band knife 16, and passes through a traveling nut 92 on the bottom of the platform 80. In view of this arrangement, it will be understood that, as the crank handle 90 is manipulated to rotate the screw 89, the traveling nut 92 will move in one direction and the traveling nut 91 will move in the opposite direction due to the opposite threads on the screw 89. Conversely when the crank 90 is manipulated to rotate the screw 89 in the opposite direction, the traveling nuts 91 and 92 will move in their opposite directions so that the band knives 15 and 16 can be moved either towards or away from each other depending on the adjustment desired.

Figure 8:
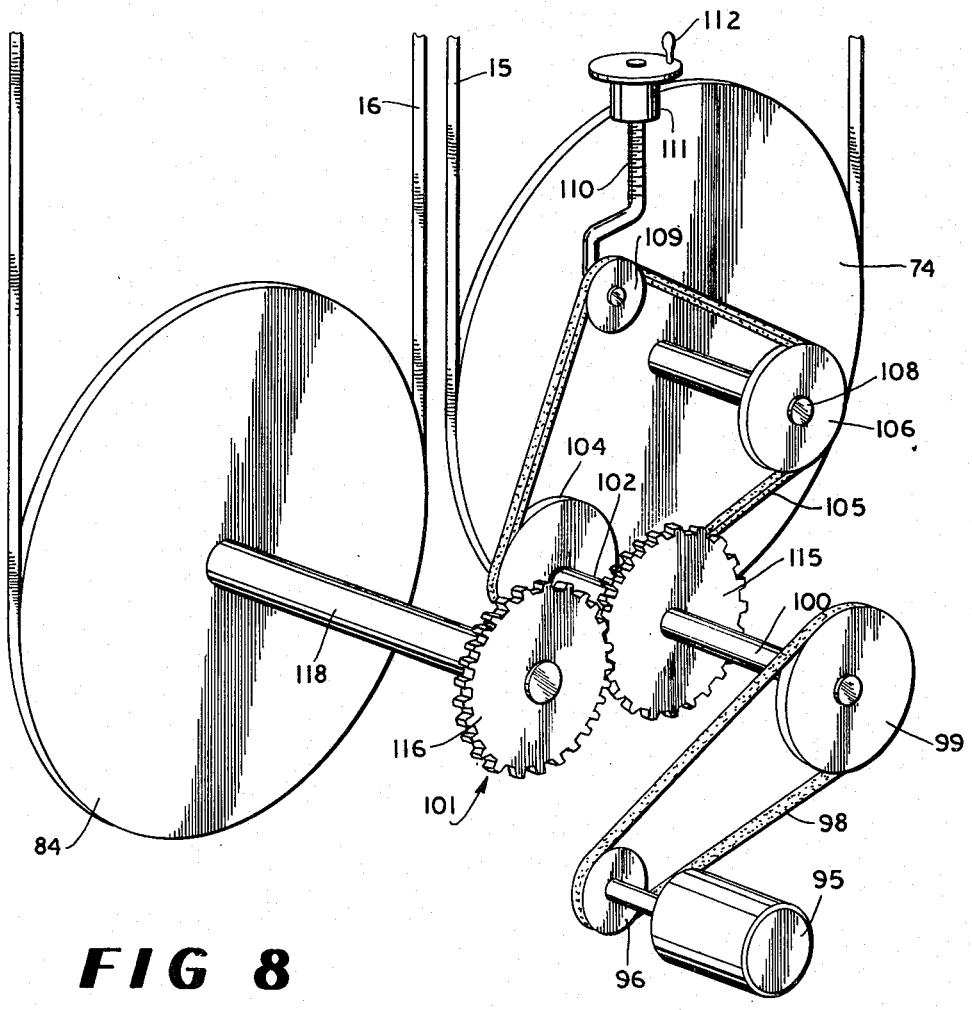

Since band knives 15 and 16 must move towards and away from each other, but must be driven in synchronism continuously, there is a single drive train to drive both the band knives 15 and 16, and this drive arrangement is shown in FIG. 8 of the drawings.

First, it should be understood that the band knives 15 and 16 move in a downward direction at the cutting station B because it has been found that the fabric can be more easily controlled by having the downward cutting direction on the fabric. With this in mind, attention is directed to FIG. 8 of the drawings which shows a drive motor 95, the drive motor 95 having a pulley 96 on its output shaft. The pulley 96 has a belt 98 trained thereover to drive the pulley 99. The pulley 99 is fixed to the end of an input shaft 100 of a transmission generally designated at 101. The shaft 100 is a straight-through drive so that there is an output shaft 102 having a pulley 104 fixed thereto, the pulley 104 having a belt 105 trained thereover and also trained over a pulley 106 that is fixed to the shaft 108 of the wheel 74. With this arrangement, it will be seen that the motor 95 rotates its pulley 96 and the pulley 99 is rotated in the same direction due to the belt connection. The pulley 99 rotates the shaft 100 and causes the pulley 104 to be rotated, again in the same direction thereby to rotate the pulley 106 also in the same direction so that the wheel 74 is rotated, again, in the same direction.

It will be noted that the belt 105 extends from the pulley 106 upwardly to an adjustable idler 109, the idler 109 being vertically adjustable in that it is carried by a threaded shaft 110, the threaded shaft being surrounded by a nut 111 which is manipulable by a crank handle 112. This arrangement is necessary because as the wheel 74 is moved outwardly, the belt 105 would need to be lengthened, and this can be done simply by manipulating the crank handle 112 to lengthen the shaft 110 and lower the idler pulley 109 so that the belt 105 will be effectively longer. Conversely, when the wheel 74 is moved inwardly, the idler 109 will be moved up to effectively shorten the belt 105 and retain proper tension on the belt 105.

Looking again at the transmission 101, it will be seen that there is a gear 115 carried by the shaft 100, the gear 115 being meshed with a similar gear 116 that is carried by a shaft 118. The shaft 118 mounts the wheel 84 so that rotation of the gear 116 also rotates the wheel 84. Since the gears 115 and 116 are of the same diameter and have the same number of teeth, the speed of the two gears will be the same, and the revolutions per minute will be the same as the revolutions per minute of the shaft 100. Thus, by maintaining the same pulley sizes throughout, the wheels 74 and 84 will be driven at the same speed; however, since the connection between the shafts 100 and 118 is by means of two gears, it will be understood that the shaft 118 rotates in the opposite direction from the shaft 100 to cause the wheel 84 to rotate in the opposite direction from the wheel 74 thereby giving the desired direction to the band knives 15 and 16 in the cutting station B.

In view of the foregoing description, it will be understood that the apparatus of the present invention provides a very convenient and very efficient means for accurately cutting overcut pattern pieces. One operator can place a stack of overcut pattern pieces in one of the clamp members 11 and the chain 25 will carry the pattern pieces through the band knives 15 and 16 which can be appropriately spaced for the desired cut. The clamp member 11 then carries the cut pattern pieces completely around the conveying means 10 until the cut pattern pieces in the clamp member 11 arrive at the unloading station C where the single operator can unload the cut pattern pieces from the clamp 11 and replace the stack with the stack of overcut pattern pieces at the station A. The larger cut away portions of the stacks of overcut pattern pieces can be retrieved by the operator at the cutting station and placed in an on-coming clamp. The process in continuous, versatile and well controlled for accurate cutting and for very high output of pattern pieces.

It will of course be understood by those skilled in the art that the particular apparatus here chosen is by way of illustration only, and is meant to be in no way restrictive; therefore numerous changes and modifications may be made and the full use of equivalents resorted to without departing from the spirit or scope of the invention defined in the appended claims.

What is claimed is:

1. Apparatus for cutting a stack of pattern pieces or the like comprising a pair of band knives having a vertical portion, said vertical portions of said pair of band knives being parallel to each other and spaced apart a distance equal to the width to which the pattern pieces are to be cut, conveying means extending between said pair of band knives, at least one clamp member carried by said conveying means, said clamp member being adapted to receive a stack of fabric and including a base plate for receiving said stack of fabric, a hold-down plate removably connectable to said base plate for holding a stack of fabric on said base plate, said hold-down plate and clamp member being of a width that will pass between said pair of band knives.

2. Apparatus as claimed in claim 1 and including means for controlling waste cut from said stack of fabric, said means for controlling waste comprising a roller for bearing against said waste, said roller being oriented so that the axis of rotation of said roller is parallel to said vertical portion of said band knives.

3. Apparatus as claimed in claim 1, said clamp member comprising a first clamp plate fixed to said base plate, and hold-down plate receiving means carried by said first clamp plate, a second clamp plate pivotally mounted on said base plate, hold-down plate receiving means carried by said second clamp plate, and spring means for urging said second clamp plate towards said first clamp plate.

4. Apparatus as claimed in claim 3, and including means for fixing said base plate to said conveying means generally at the midpoint of said base plate.

5. Apparatus as claimed in claim 3, said first clamp plate defining a first slot therein, a first tab on said hold-down plate receivable within said first slot for aligning said hold-down plate with said base plate.

6. Apparatus as claimed in claim 5, said second clamp plate defining a second slot, a second tab on said hold-down plate receivable within said second for aligning said hold-down plate with said base plate.

7. Apparatus as claimed in claim 6, said first clamp plate including a first pair of rack gears mounted parallel to each other and having a plurality of teeth, one edge of said hold-down plate being receivable between said teeth with said first tab received within said first slot.

8. Apparatus as claimed in claim 7, said second clamp plate including a second pair of rack gears mounted parallel to each other and having a plurality of teeth, one edge of said hold-down plate being receivable between said teeth with said second tab received within said second slot, said second clamp plate being pivotal away from said first clamp plate sufficiently to disengage said teeth of said second pair of rack gears from said edge of said hold-down plate.

9. Apparatus as claimed in claim 1, said conveying means comprising a continuous chain including an upper flight and a lower flight, said upper flight being substantially centered between said vertical portions of said band knives.

10. Apparatus as claimed in claim 1, said pair of band knives each including a lower wheel, an upper wheel parallel to said lower wheel, a blade trained over the peripheries of said lower wheel and said upper wheel, said vertical portion of said band knife being defined by a tangent between said lower wheel and said upper wheel, said pair of band knives including drive means for moving said vertical portions in the same direction at the same speed, and means for moving said band knives towards and away from each other with each knife of said pair of band knives moving an equal distance.

11. A system of cutting stacks of overcut garment pattern parts or the like comprising continually attaching stacks of overcut garment pattern parts in series to a continuous conveyor system at a work station, moving the plurality of stacks of overcut garment pattern parts in series on the conveyor system along a rectilinear path between a pair of cutting members, cutting the side portions of the stacks of overcut garment pattern parts with the cutting members, moving the cut garment pattern parts on the conveyor system along a return flight toward the work station, and removing the cut pattern parts from the conveyor system as the garment parts approach the work station.

12. The system of claim 11 and further including the step of retrieving some of the cut away portions of the overcut garment pattern parts at the pair of cutting members and recycling the cut away portions through the system.

13. A system of cutting stacks of overcut garment parts or the like comprising placing a stack of overlying overcut garment parts in compression in a carrier at a loading station to prevent the garment parts from moving with respect to one another, moving the carrier and overcut garment parts between a pair of cutting members at a cutting station and simultaneously cutting the opposite sides of the stack of overlying overcut garment parts with the pair of cutting members at the cutting station, moving the carrier and cut garment parts back toward the loading station to an unloading station adjacent the loading station, and removing the stack of cut garment parts from the carrier at the unloading station.

* * * * *